US007225876B2

(12) United States Patent
Laureano

(10) Patent No.: US 7,225,876 B2
(45) Date of Patent: Jun. 5, 2007

(54) CONNECTOR ASSEMBLY

(75) Inventor: Marcio P Laureano, Østerås (NO)

(73) Assignee: Aker Kvaerner Subsea Limited (GB)

( * ) Notice: Subject to any disclaimer, the term of this patent is extended or adjusted under 35 U.S.C. 154(b) by 0 days.

(21) Appl. No.: 10/533,319

(22) PCT Filed: Nov. 10, 2003

(86) PCT No.: PCT/GB03/04839

§ 371 (c)(1),
(2), (4) Date: Apr. 29, 2005

(87) PCT Pub. No.: WO2004/047231

PCT Pub. Date: Jun. 3, 2004

(65) Prior Publication Data

US 2006/0019523 A1 Jan. 26, 2006

(30) Foreign Application Priority Data

Nov. 15, 2002 (GB) ..... 0226683.1

(51) Int. Cl.
*E21B 29/12* (2006.01)

(52) U.S. Cl. ..... 166/343; 166/368; 166/88.4

(58) Field of Classification Search ..... 166/338, 166/368, 341, 343, 85.1, 88.4
See application file for complete search history.

(56) References Cited

U.S. PATENT DOCUMENTS

| | | | | |
|---|---|---|---|---|
| 4,491,176 | A * | 1/1985 | Reed | 166/66.4 |
| 4,795,359 | A * | 1/1989 | Alcock et al. | 439/271 |
| 5,443,328 | A * | 8/1995 | Alcock et al. | 405/169 |
| 6,200,152 | B1 * | 3/2001 | Hopper | 439/310 |
| 6,394,837 | B1 * | 5/2002 | Edwards et al. | 439/426 |
| 6,932,636 | B2 * | 8/2005 | Abbey et al. | 439/201 |
| 6,974,341 | B2 * | 12/2005 | Jennings | 439/191 |

* cited by examiner

*Primary Examiner*—Thomas A Beach
(74) *Attorney, Agent, or Firm*—Nixon & Vanderhye PC

(57) ABSTRACT

A reciprocable connector assembly for coupling a service line through a path in a wellhead and hangar wall, the assembly comprising: connector for coupling with a corresponding connector disposed in the hangar wall; a shuttle carrying said connector between a first position in which the connector is not coupled to the corresponding connector and a second position in which it is coupled, at least one service line connected at one end to the connector and wound in a plurality of turns to extend or retract with respect to one another as the shuttle moves between the first and second positions and a support for constraining movement of the turns.

5 Claims, 5 Drawing Sheets

CONNECTOR ASSEMBLY

This application is the U.S. national phase of international application PCT/GB2003/005849 filed 10 Nov. 2003 which designated the U.S. and claims benefit of GB 0226683.1, dated 15 Nov. 2002, the entire content of which is hereby incorporated by reference.

FIELD OF THE INVENTION

This invention relates to the provision of service lines, in particular but not exclusively electrical power to down hole equipment in oil wells, especially to those in extreme environments such as subsea where access is difficult. The invention also relates to the routing of a power connection or optical fibre connection through respective inner and outer cylindrical members of an oil well.

BACKGROUND TO THE INVENTION

Oilfield wells and wellheads have a generally common configuration with nested cylindrical members. Installation of the members progresses from outer larger diameter members to inner smaller diameter members that are hung or landed on inwardly projecting portions of the surrounding outer members. The upper portions of the cylindrical members, or hangars, are generally of a more substantial annular thickness than the rest of the cylindrical member that suspends from it.

At the production stage of a well, production tubing extends down to the production zone, from where, due to differential pressure in the reservoir, oil or other hydrocarbons flow up the production tubing providing there is no mechanical barrier or blockage. However, some reservoirs do not have a high enough pressure to produce naturally and some form of artificial lift is required.

One way of providing lift is by an electrical submersible pump (ESP) installed at the bottom of the production tubing to pump the oil up the tubing. Heaters and signal paths for control equipment may also be provided. The power and signal lines for these functions need to run with the production tubing down to the reservoir.

In many applications, electrical connections are made through the top of the tubing hangar. However, space is limited, and while top entry connection and other systems, can be satisfactory for signal paths where the power requirements are generally well below 220 Watts and the cables are relatively small and compact, there is a problem in routing the larger cables required for the substantial power requirements of equipment such as electrical submersible pumps which may require over 1 KW, often 5 KW or more For example it may require the production bore to be off-centre, which has serious operational implications in ensuring equipment is correctly aligned. Furthermore, the blow out preventer has to be removed for access to the top of the tubing hangar. The tubing hangar then provides the only barrier, which causes a safety problem if the well is live.

As with any well application, pressure sealing and access without having to shut off production are required or desirable.

On way of overcoming spatial problems of top entry is to provide connections via radial penetrations. However, these require that the connector bridge the annulus between concentric members and thus the connection has to be breakable in order to allow relative vertical movement of the concentric members.

U.S. Pat. No. 6,200,152 shows electrical power and signal connections using a radial penetration to avoid problems of connection via the top of the tubing hangar. A horizontal penetration passes through concentrically disposed casings, the inner casing being a tubing hangar and the outer casing a spool body. Seals are provided between the spool body and tubing hangar to enable formation of a sealed enclosure extending from a connector portion in the wall of the tubing hangar to a shuttle housing mounted externally of the spool body. A shuttle is reciprocable in the enclosure from a position within the spool body into contact with the connector portion in order to make electrical contact. It is necessary for the cable to be able to move to allow such shuttle movement. For signal cables a loose flexible coil of cable that can expand is used, but this has been considered not possible for substantial electrical power cables, and a sliding contact on a fixed power core is used instead.

Provision of a sliding contact is complex and it is generally desirable to have fixed contacts for electrical power connections as well as for electrical signal connections.

Problems may also arise in providing optical fibre couplings in that these are sensitive to bend radius and so loose coils are not always satisfactory.

SUMMARY OF THE INVENTION

The present invention is directed towards enabling utilization of a flexible coil in an electrical power connection or optical fibre connection for down hole equipment in an oil well by providing support for the coils which may assist or control their movement.

According to the invention there is provided a reciprocable connector assembly for coupling a service line through a path in a wellhead and hangar wall, the assembly comprising: a connector for coupling with a corresponding connector disposed in the hangar wall; a shuttle carrying said connector between a first position in which the connector is not coupled to the corresponding connector and a second position in which it is coupled, at least one service line connected at one end to the connector and wound in a plurality of turns to extend or retract with respect to one another as the shuttle moves between the first and second positions and a support constraining movement of the turns.

The invention also provides an assembly for providing a service line connection through a wellhead member and tubing hangar, the assembly comprising: a wellhead member having a first passageway through a wall thereof; a hangar body having a second passageway therethrough and a coupling element disposed within the second passageway; a reciprocable shuttle carrying a connector, the shuttle being disposed for translation between a retracted position in which the connector and coupling element are not connected and an extended position in which the connector and coupling element are coupled, at least one service line being fixedly connected to the connector and looped in a plurality of supported turns that expand as the shuttle moves to the extended position.

BRIEF DESCRIPTION OF THE DRAWINGS

The invention is now described by way of example with reference to the following drawings in which.

DETAILED DESCRIPTION OF PREFERRED EMBODIMENTS

Figure 1:
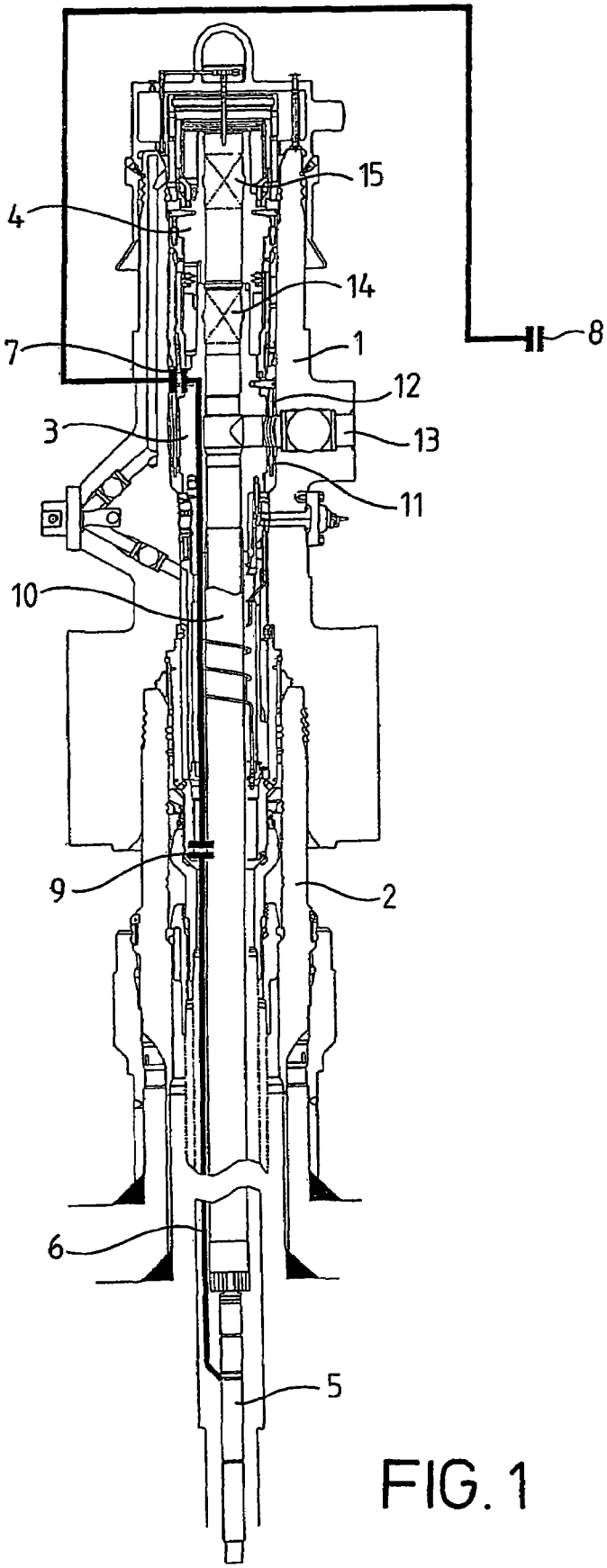
FIG. 1 is a diagrammatic axial section through a wellhead assembly showing general routing of a power cable in a subsea wellhead.

Referring to FIG. 1, the general wellhead arrangement of the routing of a power cable to a down hole pump is shown. Within the context of this description, a power connection is one generally rated above 110 volts and 2 amps (220 watts) but most frequently it will be very substantially above that, for example 1 to 5 KW or higher. The arrangement of the wellhead and tubing is of typical known configuration and is not described in detail. In the Figure a so-called horizontal tree 1 is shown in which oil from production tubing 10, with bore 13, is passed laterally to a horizontal continuation of the production bore. Production is aided by a down hole pump 5 to which a power cable 6, usually supplying three phase power, is connected. The cable 6 runs down the outside of the production bore within a tubing suspended from a tubing hangar 3 that is landed within the spool body of the horizontal tree 1. In environments such as subsea, the breakable connections need to be made remotely or by diver.

The power coupling passes through the walls of the tubing hangar and spool body of the tree and connection is made and broken via a reciprocable connector, detail of which is shown and described with reference to FIGS. 2 to 5. From FIG. 1 it is significant to note that the power cable passes through the tubing hangar wall at a location above the production bore 13, which is an extension of the production tubing 10.

A sealed driving mechanism housing 16 attaches to the outside of the penetration through the spool body.

Tubing hangar seals 11 and 12 below the penetration through the hangar wall, a tubing hangar high pressure plug 14 above the penetration and tree cap 4 and plug 15 define, with the housing 16, a sealed enclosure which is not located on the production flow path or in direct contact with the annuli of the production tubing.

Within the penetration a wetmate connection 7 can be made and broken. When the connection is broken, vertical movement of the hangar tubing, for installation or removal, is enabled. Externally of the spool the power cable connects to a wet-mate connector 8. Within the wellhead assembly the cable has a dry-mate connector 9 at the base of the tubing hangar 3.

Figure 2:
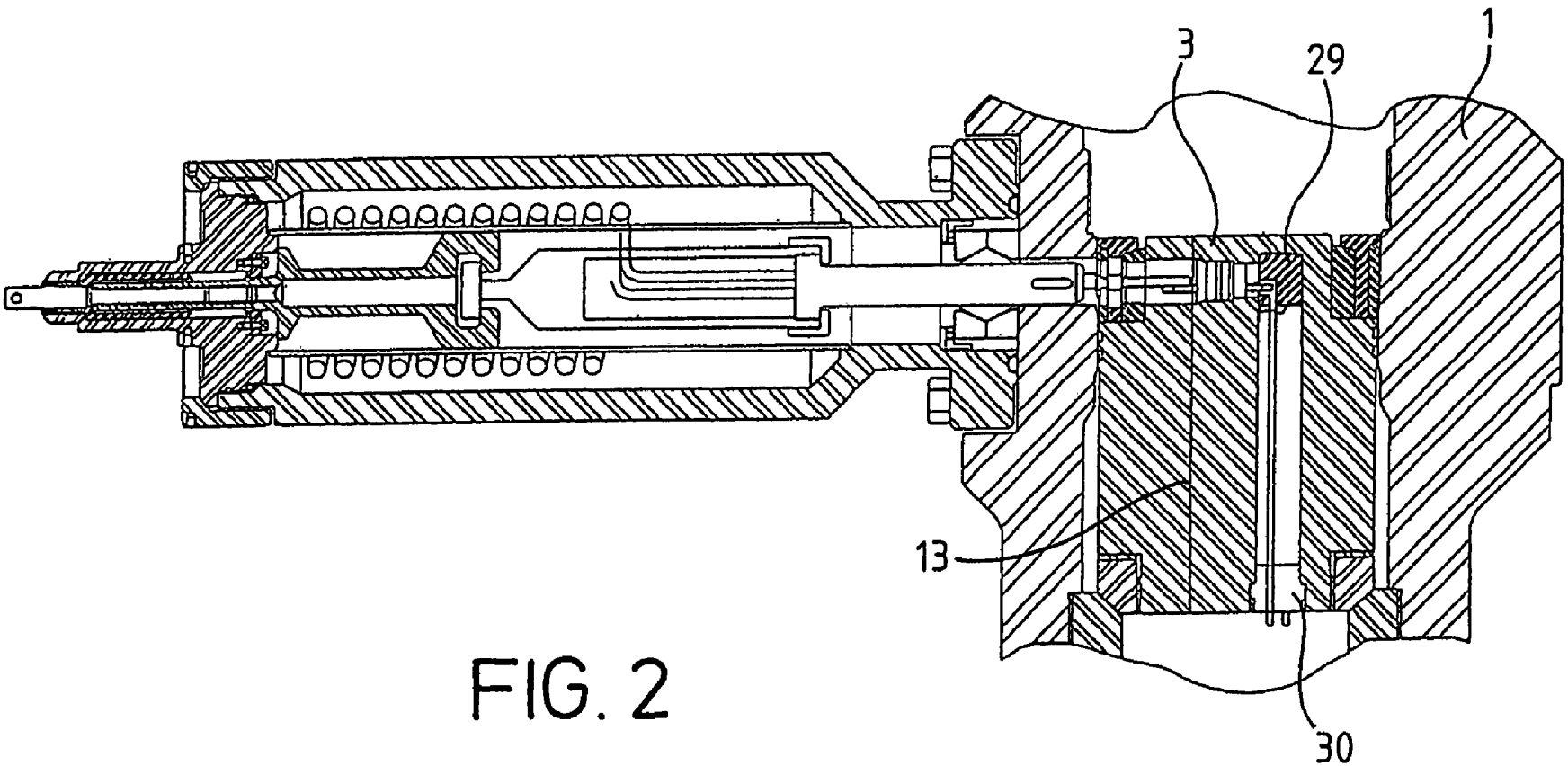
FIG. 2 is a vertical section showing an embodiment of a power connection in accordance with the invention.

Referring now to FIG. 2, a vertical section through the pathway of the penetration and connector assembly is shown. The connector assembly 7 comprises the housing 16 mounted on and sealed to the spool body of the tree 1. Within the housing a drive member 23 reciprocates one connector member 21, in this embodiment a receptacle, into or out of connection with a cooperating connector member 22, in this embodiment a plug. The connector member 21 retracts to within the penetration of the spool body. It will be appreciated plug and receptacle functions may be interchanged or other forms of connectors provided.

The plug 22 is located within a horizontal portion of a penetration in the tubing hangar 3. After the location of the plug 22, the penetration changes direction and extends vertically down, emerging out of the base of the tubing hangar. The cable 6 is clamped to the outside of production tubing 10. The remaining part of the plug connector, shown as portion 29, extends through the vertical portion of the penetration. Various constructions are possible for implementing the horizontal to vertical change of direction of the conductors. For example conductor pins from plug 22 may connect to a set of conductors in portion 29 which are bent from horizontal to vertical, or the change of direction may be implemented by other means. For installation, the portions 22 and 29 are separable and a seal to the passageway and further connector 30 is at the exit of the passageway. This connector is part of dry-mate connection 9 (FIG. 1).

Providing the vertical routing for the power connector in the tubing hangar enables more space and allows the production bore of the tubing hangar to be concentric with the spool body, which facilitates both installation and other interventions.

Figure 3:
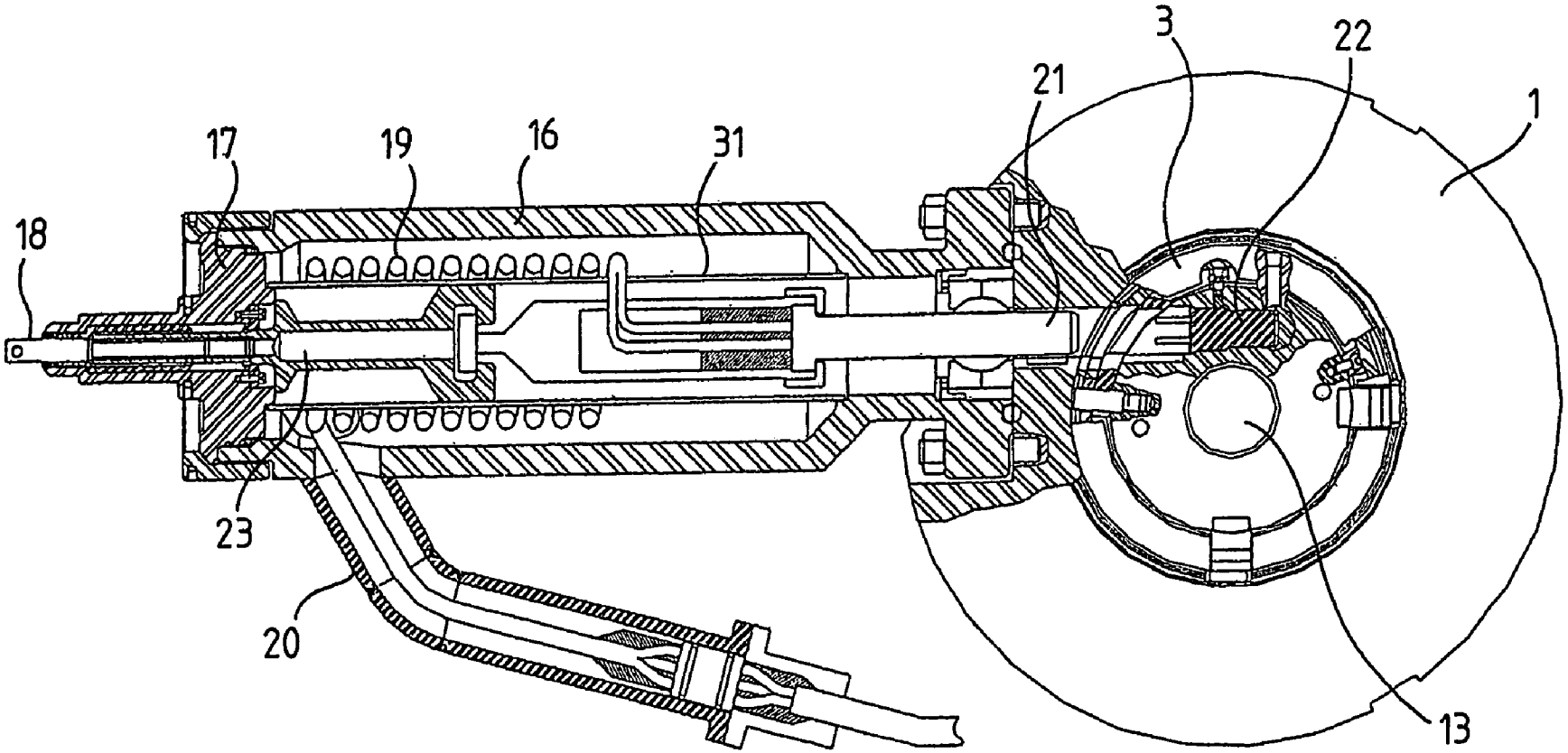
FIG. 3 is a diagrammatic plan section through a wellhead assembly showing the connector assembly of FIG. 2 in a retracted, no electrical contact, configuration.
Figure 4:
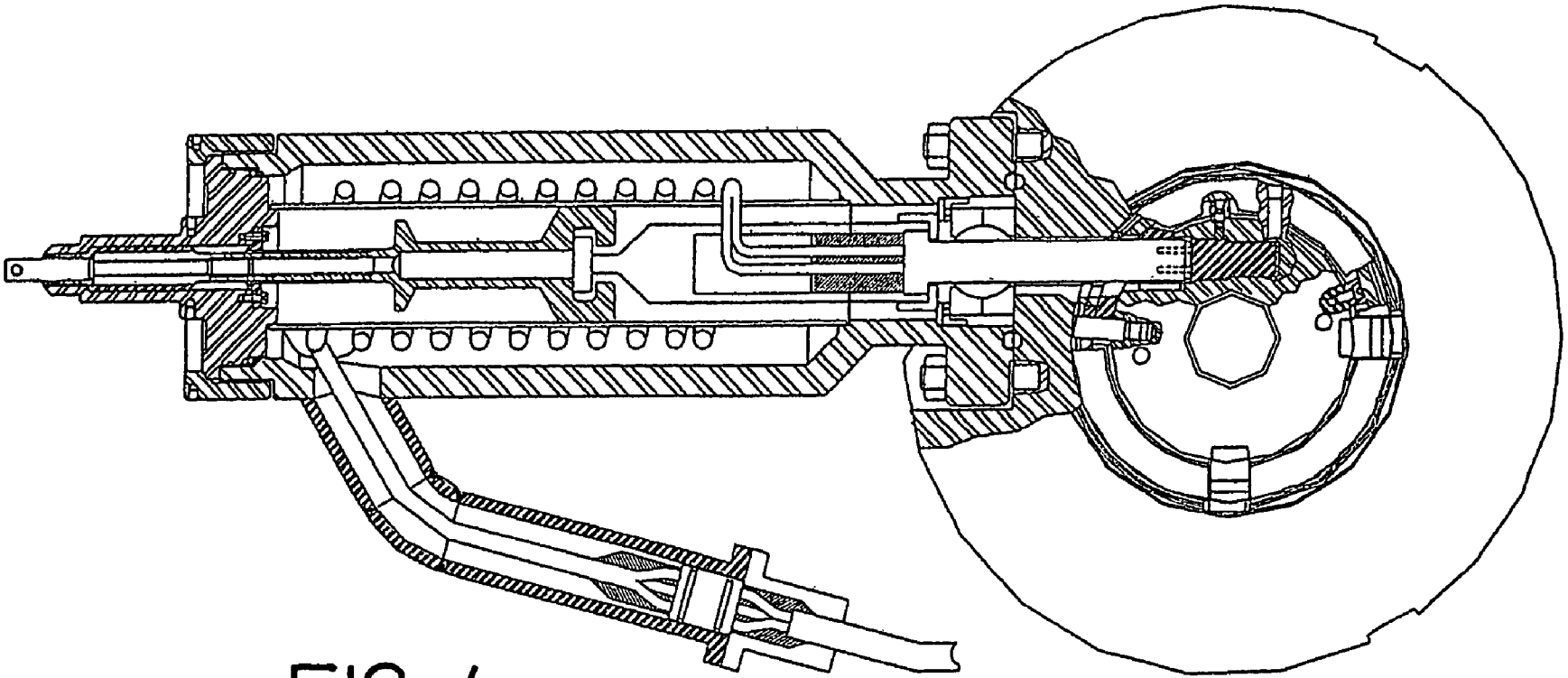
FIG. 4 is a diagrammatic plan section similar to FIG. 3 showing the connector assembly in the extended, making electrical contact, configuration.
Figure 5:
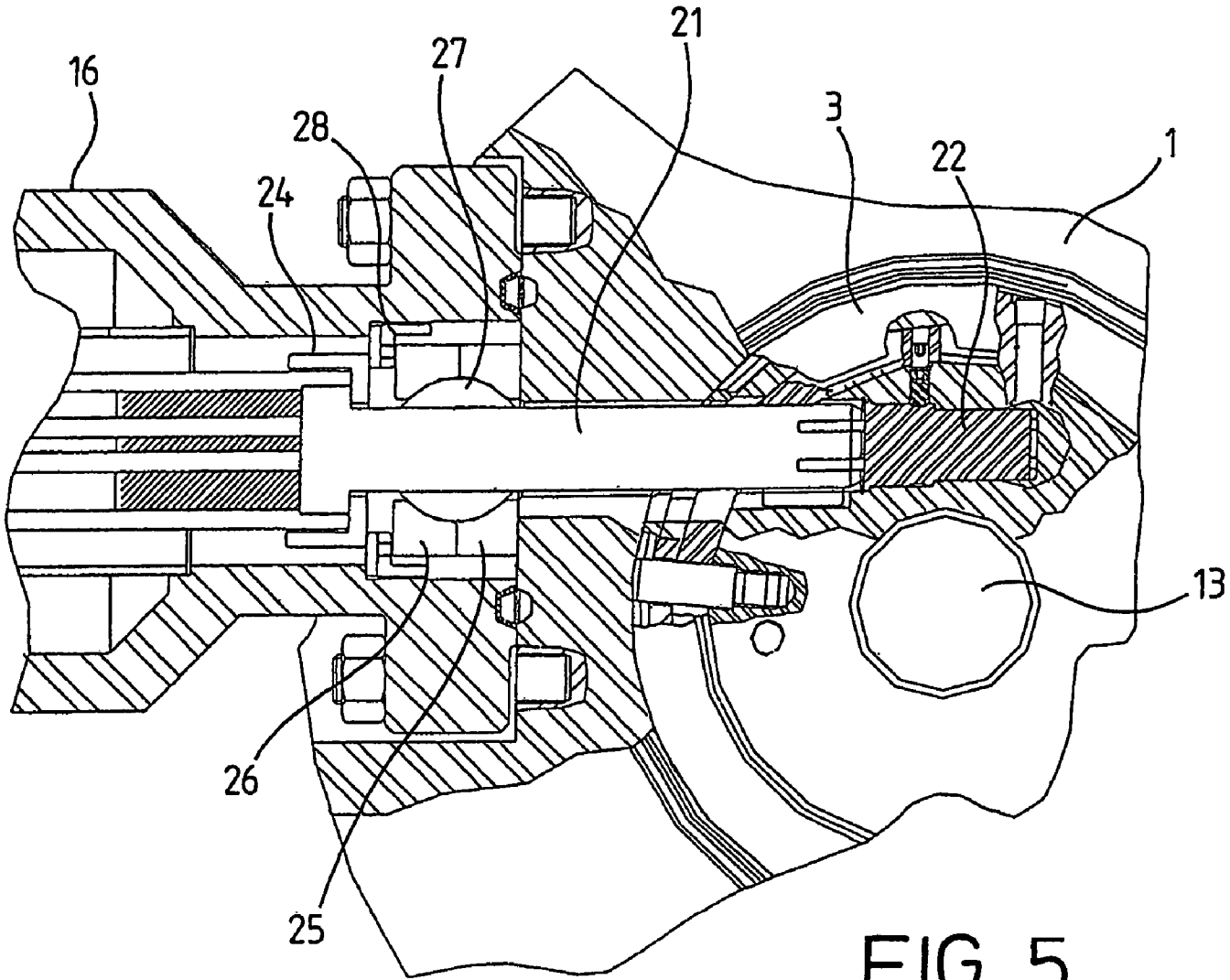
FIG. 5 is an enlarged plan view of part of the connected connector assembly of FIG. 4.

Turning now to FIGS. 3 to 5, the operation of the drive member and other features of the connector assembly can be seen.

Within housing 16, a cable 19 is provided which connects at one end 19*a* to the connector receptacle, it then winds helically around a spool 31 and exits the housing into arm 20 from where the cable extends to power connection 8 (FIG. 1). The housing is sealed by an end cap 17.

As explained with reference to FIG. 1, the penetration and housing are part of the sealed enclosure above the exit of the production bore and so it is not subject to extreme conditions. Thus the cable 19 does not need to be armoured, but may comprise just a main core and insulation. For this reason it is flexible enough to be wound in the helical configuration. The individual cores of the three phase cable may be separated and wound separately in order to provide more flexibility, or, depending upon power rating, may be wound together. The cores each engage with a respective pin on the plug connector. It would be possible to have separate shuttle mechanisms for each core, but it is preferred to require only a single operation.

FIG. 3 shows the receptacle 21 disconnected from the plug 22, in the configuration that permits relative vertical movement of the tubing hangar. FIGS. 4 and 5 show the receptacle 21 translated into engagement with the plug 22. This translation is brought about by a pushing member 23 which is connected to a threaded rotary stem 18 that passes through the end cap 17. The stem 18 can be rotated externally by a diver or remotely operated vehicle to effect the coupling and decoupling as required.

By comparing FIGS. 3 and 4, it will be seen that turns of the helix of cable 19 have extended and translated along the spool as end 19*a* moves. There is sufficient flexibility in the cable turns to accommodate the required movement before the fixed point where the cable enters arm 20. The fact that the turns are supported by the spool 31 rather than loose during the translation constrains their movement to the axial direction. This encourages even movement and distribution of the extension and retraction of the turns with respect to one another. When there are multiple sets of single core turns the spool or other form of support may be arranged to maintain their spatial separation. For example multiple spools may be provided. As shown the spool is static and the coil or coils slide over it, but it may be desirable to provide a translating spool in some circumstances. For example so that the pull on the turns can be distributed.

The spool may be a cylindrical member with a slot for the cable where it passes inside to connect to the receptacle, or the spool may be an open framework Concentric spools for separated cores may be provided. Guide ridges or stops on the surface of the spool may be incorporated to confine the translation of one or more of the turns so as to ensure even movement. For very heavy cables, sliding carriers attached to the turns and sliding on the spool or in a track may be used.

As an alternative to a spool, other coil support may be provided. The objective is to assist even movement and resist entanglement or collapse. Conveniently the support, which could be a single rod (with or without stops or carriers) is located inside the turns of the cable. However, it may be possible to provide external support, for example from which the turns (or some) are hung.

A problem that can occur with location of a reciprocating member, is the alignment of the member with the tubing hangar penetration. For example if the tubing hangar 2 is located out of position as may happen due to debris accumulated on the landing shoulder or from machining tolerances. To overcome alignment problems the connector receptacle (see FIG. 5) passes through a spherical joint 27 that is held in place between support members 25 and 26. The spherical joint allows some angular freedom of movement to the receptacle 21. Also, the spherical joint is mounted in a floating plate 28 providing freedom to float in the radial direction. A carrier plate 24 at the end of the receptacle away from the plug serves as a stop when reaching the end of the stroke required for mating, subject to the play allowed by the floating plate 28. In an alternative arrangement the compliance mechanism may be a plate mounted on springs, the plate behaving similarly to the sphere described above.

Although described in the context of a shuttle connector in a horizontal to vertical radial penetration, it will be appreciated that the connector may be utilised in other installation configurations. For example the connection may be made with the penetration and connector angled downwardly rather than horizontal.

The arrangement of carried coils described for a power line is also useful for other service lines where bend radius is sensitive, for example with optical fibres. In such an arrangement optical connectors would replace electrical connectors and bend limiting sheaths may also be provided.

The invention claimed is:

1. A reciprocable connector assembly for coupling a service line through a path in a wellhead and hangar wall, the assembly comprising:

a connector for coupling with a corresponding connector disposed in the hangar wall;

a shuttle carrying said connector between a first position in which the connector is not coupled to the corresponding connector and a second position in which it is coupled, spool including an aperture, said shuttle being moveable between said first and second positions within said spool;

at least one service line connected at one end to the connector and extending out of said aperture, said service line being wound in a plurality of turns extending along and outside said spool whereby said turns are supported on the inside thereof by said spool as said turns move with respect to one another as the shuttle moves between the first and second positions.

2. A reciprocable assembly according to claim 1 in which the service line is a power line.

3. A reciprocable assembly according to claim 1 in which the service line is an optical fibre line.

4. An assembly for providing a service line connection through a wellhead member and tubing hangar, the assembly comprising:

a wellhead member having a first passageway through a wall thereof;

a hangar body having a second passageway therethrough and a coupling element disposed within the second passageway;

a reciprocable shuttle carrying a connector, the shuttle being disposed for translation between a retracted position in which the connector and coupling element are not connected and an extended position in which the connector and coupling element are coupled, a spool including an aperture, said shuttle being moveable between said first and second positions within said spool:

at least one service line being fixedly connected to the connector and extending out of said aperture, said service line being wound in a plurality of turns on and extending along said spool whereby said turns are supported on the inside thereof by the spool as said turns relatively expand as the shuttle moves to the extended position.

5. A connector assembly for coupling electrical power through a path in a wellhead and hangar wall, the assembly comprising:

a first connector for coupling with a corresponding second connector disposed in the hangar wall;

a reciprocatable member for moving said first connector between a first position in which said first connector is not coupled to said corresponding second connector and a second position in which it is so coupled;

a spool including an aperture, said shuttle being moveable between said first and second positions within said spool;

at least one service line connected at one end to said first connector and extending through said aperture, said electrical power line being wound in a plurality of turns on and extending along said spool whereby said turns are supported on the inside thereof by said spool and said spool constrains said turns to move only axially as said turns extend or retract with respect to one another when said first connector is moved between said first and second positions.

* * * * *